US005566851A

United States Patent [19]

Sasaki et al.

[11] Patent Number: 5,566,851

[45] Date of Patent: Oct. 22, 1996

[54] LIQUID CONTAINER AND MOUTH THEREOF

[75] Inventors: Yasuyuki Sasaki; Takehiko Bizen, both of Shinjuku-ku, Japan

[73] Assignee: Dai Nippon Insatsu Kabushiki Kaisha, Japan

[21] Appl. No.: 179,975

[22] Filed: Jan. 11, 1994

Related U.S. Application Data

[63] Continuation-in-part of Ser. No. 683,288, Apr. 10, 1991, abandoned.

[30] Foreign Application Priority Data

Apr. 11, 1990 [JP] Japan ..... 2-95574

[51] Int. Cl.[6] ..... B65D 77/06

[52] U.S. Cl. ..... 220/441; 222/105; 222/183

[58] Field of Search ..... 222/105, 183, 222/189, 529; 220/441

[56] References Cited

U.S. PATENT DOCUMENTS

| | | | |
|---|---|---|---|
| 4,381,846 | 5/1983 | Heck | 222/105 |
| 4,524,458 | 6/1985 | Pongrass et al. | 222/183 |
| 4,601,410 | 7/1986 | Bond | 222/105 |
| 4,817,824 | 4/1989 | La Flau et al. | 222/105 |
| 4,893,731 | 1/1990 | Richter | 222/105 |
| 4,998,990 | 7/1991 | Richter et al. | 222/105 |

FOREIGN PATENT DOCUMENTS

| | | |
|---|---|---|
| 0138620 | 4/1985 | European Pat. Off. . |
| 86/00868 | 2/1986 | WIPO . |

*Primary Examiner*—Joseph Man-Fu Moy
*Attorney, Agent, or Firm*—Ladas & Parry

[57] ABSTRACT

A liquid container has a herd outer box, a flexible inner bag and a path forming member for forming a liquid path communicated with a mouth which has a restricted path for permitting the liquid to flow out of the mouth slowly.

20 Claims, 17 Drawing Sheets

LIQUID CONTAINER AND MOUTH THEREOF

This is a continuation-in-part application upon U.S. Ser. No. 07/683,288 filed Apr. 10, 1991 now abandoned.

BACKGROUND OF THE INVENTION

This invention relates to a liquid container and its mouth, and more particularly to a liquid container of bag-in-box type in which a flexible bag for containing a liquid having a high viscosity is accommodated in an outer hard box and a mouth fixed to the liquid container for filling and taking the liquid into and out of the liquid container therethrough. There has appeared a bag-in-box in which a flexible inner bag for containing a liquid such as juice, syrup, beer or ink is accommodated in an outer box made of hard material such as cardboard, plastic and the like. A pump is connected to a mouth of the bag-in-box to take liquid contents out of the flexible inner bag.

However, when the liquid contents are sucked out, the inner flexible bag is deformed to be apt to close the mouth thereof thereby make impossible taking out of liquid contents any more. In the case of liquid having a high viscosity such as ink or adhesive, this phenomenon occurs prominently.

Further, such a bag-in-box is normally set upside down, that is, with the mouth directed downwardly. When the pump is connected to the mouth to such the liquid contents out of the inner bag, a cap fixed to the mouth is disconnected therefrom to expose an inner plug with a membrane for closing the liquid path of the mouth. A connector on the side of the pump is connected to the mouth, and a projection formed in the connector breaks the membrane to open the path for the liquid contents. The structure of the mouth increases its cost because the inner plug and the projection for breaking the membrane of the inner plug are necessary.

SUMMARY OF THE INVENTION

It is an object of this invention to provide a liquid container from which liquid contents can be taken out sufficiently with a small amount of the remaining liquid contents therein.

It is another object of this invention to provide a mouth for permitting liquid contents with a high viscosity to flow slowly therethrough.

According to one aspect of this invention, there is provided a liquid container for containing a liquid therein such as juice, syrup, ink, adhesive and the like which comprises an outer box having at least one flat wall, a flexible inner bag accommodated in the outer box, a mouth fixed to the inner bag so as to be projected outwardly of the flat wall of the outer box, and a path forming member in the shape of a flat wall provided along the flat wall of the outer box in the inner bag so as to cover almost all of the flat wall of the inner bag, including the mouth therewith for ensuring a liquid path between the flat wall of the inner bag and a flat base portion of the path forming member, all liquid paths being connected to the mouth, the path forming member having a plurality of liquid openings for communicating the liquid paths with an upper space over the path forming member in the inner bag, wherein the path forming member has a number of projections provided at predetermined intervals, and is accommodated in the inner bag with the projections directed toward the flat wall of the inner bag so as to form lattice-like liquid paths.

According to another aspect of this invention, there is provided a liquid container for containing a liquid therein such as juice, syrup, ink, adhesive and the like which comprises a flexible bag for containing the liquid therein, a mouth fixed to the flexible bag so as to be projected outwardly of the bag, and a path forming member in the shape of a flat wall provided in the flexible bag so as to cover almost all of a lower flat portion of the flexible bag to which the mouth is fixed when the liquid is filled into the bag for ensuring liquid paths between a flat base portion of the path forming member and the lower flat portion, all liquid paths being connected to the mouth, the path forming member having a plurality of liquid openings for communicating the liquid paths with an upper space over the path forming member, the path forming member having a number of projections provided at predetermined intervals, and is accommodated in the flexible bag with the projections directed toward the lower flat portion of the flexible bag.

According to still another aspect of this invention, there is provided a month provided on a container for containing a liquid with a high viscosity for flowing the liquid into and out of the container, which comprises a main body fixed to the container for containing the liquid and having a restricted path inside thereof for flowing the liquid with a high viscosity out of the mouth, the restricted path being formed of a plurality of elastic tongue pieces projected radially from an inner wall of the mouth, the tongue pieces being extended flatly in a direction perpendicularly to an axis of the mouth, and a cap detachably provided on the mouth to those and open the mouth.

Further objects, features and other aspects of this invention will be understood from the following detailed description of the preferred embodiment of this invention with reference of the drawings.

DETAILED DESCRIPTION OF THE INVENTION

As conductive to a full understanding of the nature and utility of the present invention, a brief consideration of a typical liquid container will be first presented below with reference to FIG. 31.

Figure 31:
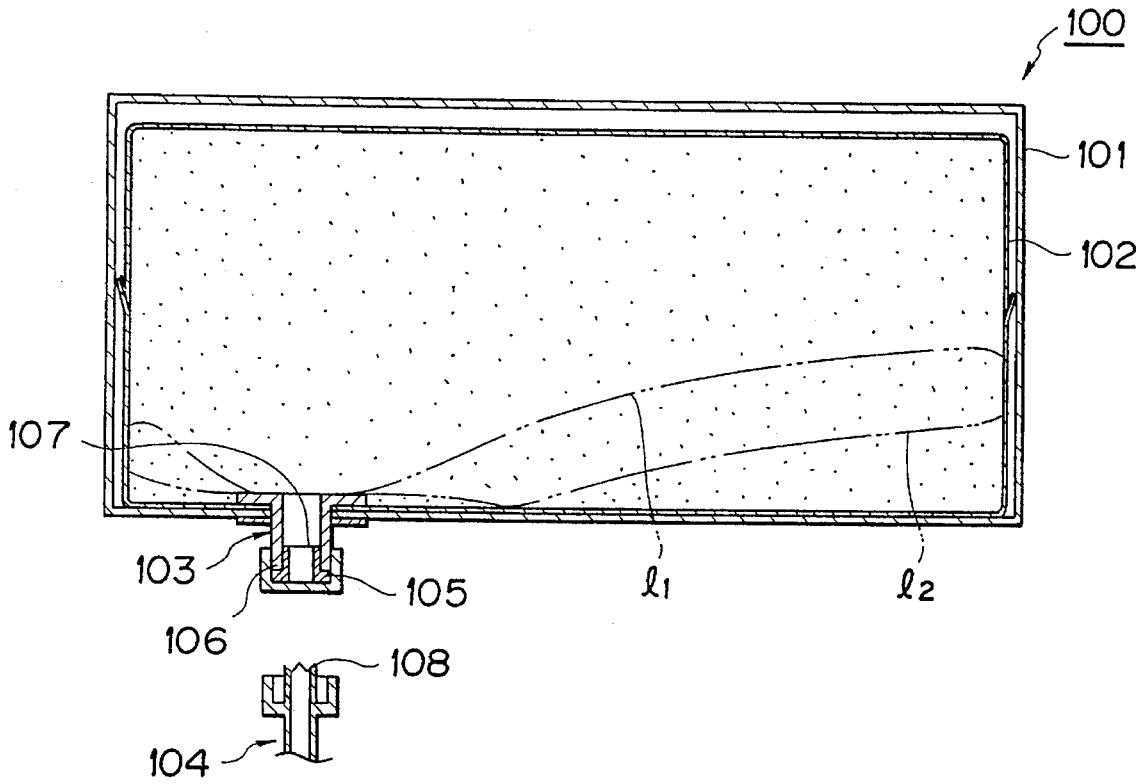
FIG. 31 PRIOR ART
FIG. 31 is a longitudinally sectional view of a conventional bag-in-box.

FIG. 31 shows a so-called bag-in-box 100 for containing liquid such as juice, syrup, ink, adhesive or the like. The box 100 comprises an outer hard box 101 formed of paper, cardboard, plastic or the like and a flexible inner bag 102 accommodated in the outer box 101 and formed of plastic film or the like. A mouth 103 is fixed to a part of the inner bag 102 so as to be projected outwardly from the outer box 101. The mouth 103 is connected to a connector 104 when the liquid contents are taken out of the inner bag 102 by a pump (not shown). As the liquid contents are taken out therefrom, the inner bag 102 is deformed so that the volume of the inner bag 102 is decreased.

However, when the liquid contents are simply sucked from the inner bag 102 by the pump, the liquid contents are partially sucked to be apt to form wrinkles on the inner bag 102. Further, a part of the inner bag 102 is tightly adhered to the bottom of the inner bag 102 before the liquid contents are not totally taken out thereby to leave a part of the liquid contents in the inner bag 102. Especially, in the case of a liquid having a high viscosity such as ink, and adhesive, this problem often occurs.

That is, in such a case, the liquid such as ink does not flow smoothly in the inner bag 102 not to reach the mouth 13 easily when the ink is sucked out of the inner bag 102. Therefore, the ink near the mouth 103 is mainly sucked, the upper portion of the flexible inner bag 102 is deformed as indicated by a dotted line l1, resulting in closing the mouth 103 in a state wherein a large amount of ink is left in the inner bag 102 or resulting in that the bottom and the upper portion of the inner bag 102 contact partially near the mouth 103 together with each other to obstruct the flow of the remaining ink.

In addition, the bag-in-box 100 is normally used in an upside down manner. When the connector 104 is connected to the lower end of the mouth 103, a cap 105 is disconnected from the mouth 103. An inner plug 106 is inserted into the mouth 103 is prevent the liquid such as ink from flowing out when the cap 106 is disconnected therefrom. The inner plug 106 has a membrane 107 which is broken by a projection 108 formed in the connector 104 when the connector 104 is connected to the mouth 103.

This invention is made to provide a liquid container whose liquid contents can be almost completely taken out therefrom and which has an inexpensive mouth with a relatively simple structure to enable liquid contents to flow out through the mouth.

A preferred embodiment of this invention will now be explained.

Figure 1:
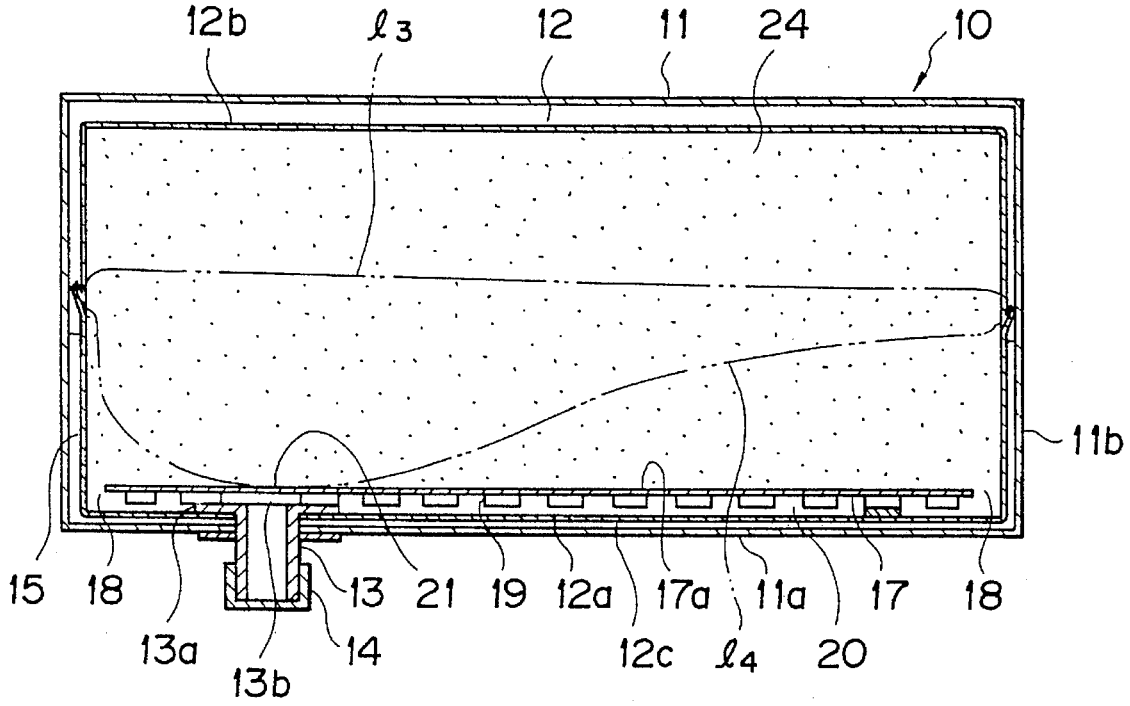
FIG. 1 is a longitudinally sectional view of a bag-in-box according to this invention.
Figure 2:
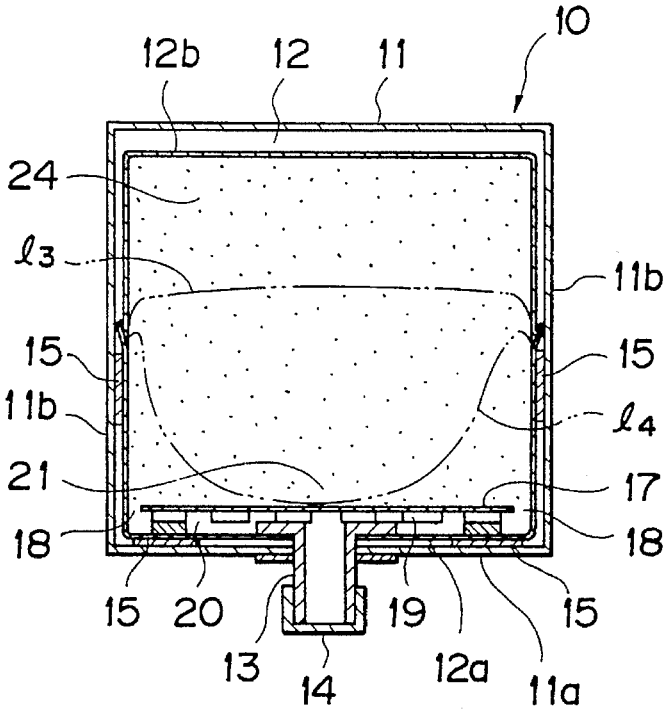
FIG. 2 is a cross sectional view of the bag-in-box shown in FIG. 1.
Figure 3:
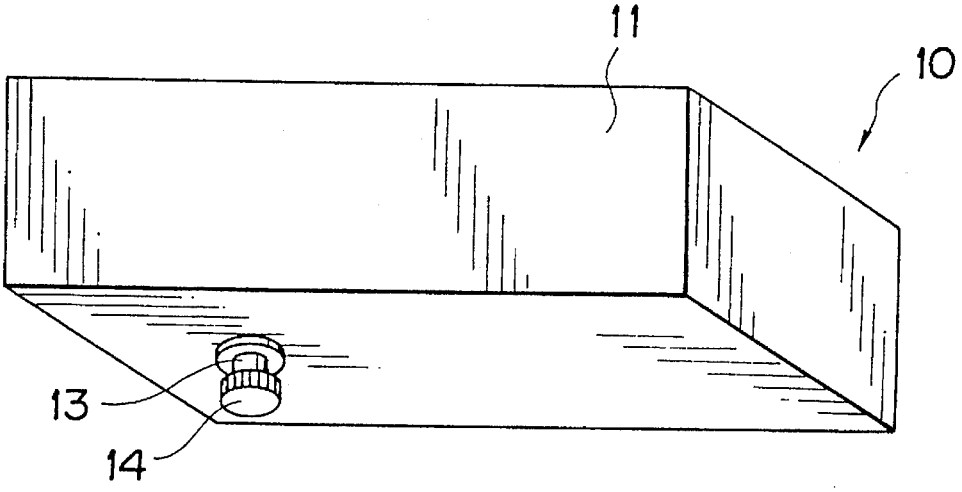
FIG. 3 is a perspective view of the bag-in-box shown in FIGS. 1 and 2.

In FIGS. 1, 2 and 3, a liquid container 10 for containing a liquid 24 having a high viscosity such as ink, adhesive or other viscous liquids comprises a rectangular outer box 11 made of hard material and an inner flexible bag 12 accommodated in the outer box 11. A mouth 13 is fixed to the inner bag 12, and the lower end of the mouth 13 is closed by a cap 14. The mouth 13 is also fixed to the outer box 11 so as to be projected from its flat bottom surface 11*a*. The inner bag 12 has a lower sheet portion 12*a* and an upper sheet portion 12*b*. The lower sheet portion 12*a* to which the mouth 13 is fixed is held by a proper adhesive means, e.g., a both-face-tape 15 whose front and back surfaces have adhesive, to the bottom flat surface 11*a* of the outer box 11 and the side flat surface 11*b* thereof whereby a lower flat portion 12*c* in the shape of a flat wall forming a part of the lower sheet portion 12*a* is formed along the flat bottom surface 11*a* of the outer box 11. Instead of the both-face-tape, an adhesive such as hot-melt may be used. The upper sheet portion 12*b* of the inner bag 12 is freely accommodated in the outer box 11. In this manner, if the lower sheet portion 12*a* of the inner bag 12 is fixed to the inner wall of the outer box 11, the upper sheet portion 12*b* of the inner bag 12 is only deformed in a state wherein the joint portion between the lower and upper sheet portions 12*a*, 12*b* is held on the inner intermediate surface of the outer box 11 when ink is filled into and taken from the inner bag 12. Therefore, the stable deformation of the inner bag 12 is ensured and the remaining amount of ink accommodated in each bag-in-box manufactured becomes even.

The outer box 11 and the inner bag 12 may be made of known various materials. For example, as the outer box 11, paper, corrugated cardboard, plastic, metal and the like may be used, and, as the inner bag 12, a single layer film, a laminated film formed of the same material or a laminated film formed of combination of plastic and paper, or combination of plastic, paper, metallic film and the like may be used. Moreover, the mouth 13 may be a plastic molding product.

In the inner bag 12 is accommodated a path forming plate as a path forming member 17 for maintaining a path of ink especially when the ink is taken out of the inner bag 12 in such a manner that the opening of the mouth 13 is covered therewith. The path forming plate 17 is disposed along the bottom walls 11*a*, 12*c* of the outer box 11 and the inner bag 12, and fixed, by adhesive at a plurality of position, to the lower flat portion 12*c* of the inner bag 12.

The largeness of the path forming plate 17 is not limited, and, however, an area slightly less than that of the lower flat portion 12*c* of the inner bag 12 is preferable as shown in FIGS. 1 and 2. That is, the path forming plate 17 extends over the almost whole portion of the lower flat portion 12*c*. The path forming plate 17 is also disposed so as to form an ink path 18 between the periphery of the plate 17 and the bottom corners of the inner bag 12.

Figure 4:
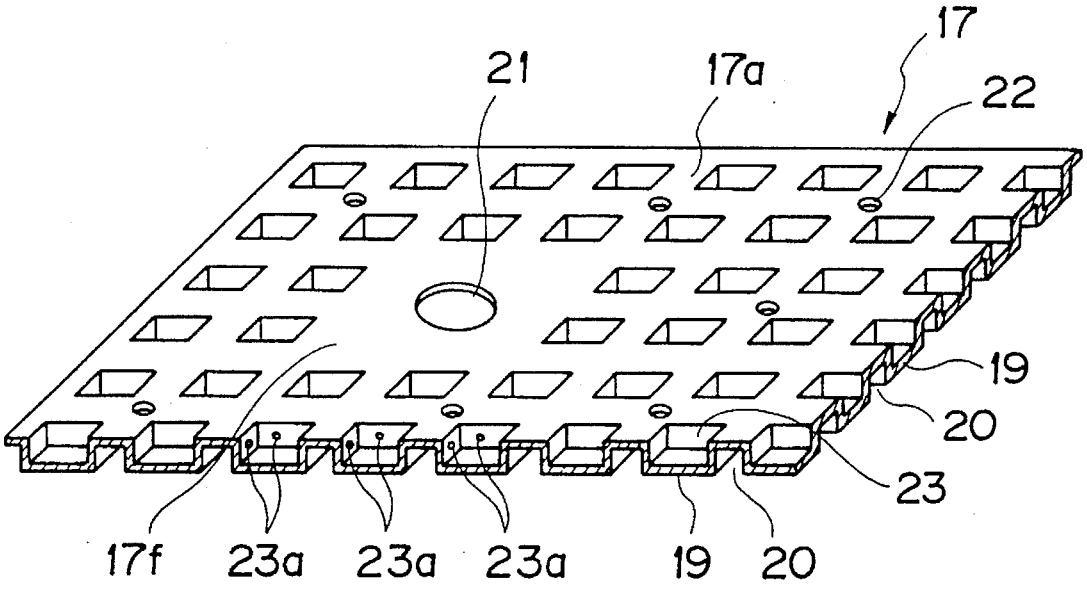
FIG. 4 is a perspective view of a path forming plate accommodated in an inner bag of the bag-in-box.

As shown enlargedly in FIG. 4, the path forming plate 17 comprises a flat base portion 17*a* and a number of projections 19 forming at predetermined intervals, which are projected in one direction from the flat base portion 17*a*. The plate 17 is, as shown in FIGS. 1 and 2, disposed in the inner bag 12 so that the projections 19 are directed downwardly to ride on the flange 13*a* of the mouth 13 and the lower flat portion 12*c* of the inner bag 12, and some projections 19 are adhered to the inner bag 12. In this embodiment, the plate 17 is adhered by heat to the inner bag 12 at four corners thereof and at two positions of the center portion thereof in a spot-like manner.

At a position of the plate 17, corresponding to the mouth 13 is provided a flat portion 17*f* without the projections 19 to facilitate passing of ink through the mouth 13. In this manner, lattice-like paths 20 for permitting ink to pass therethrough are formed between the plate 17 and the lower flat portion 12*c* of the inner bag 12. The ink paths 20 permits ink to pass therethrough toward the mouth 13 when the ink in the inner bag 12 is sacked out. In order to take int out of the inner bag 12 as such as possible, a large ink path is preferable. However, in order to decrease amount of the remaining ink in the inner bag 12 as much as possible, a small ink path is preferable because a certain amount of ink is always left in the ink path 20 after the ink is sucked from the inner bag 12. In view of these points, the size of the ink path 20 is determined. For example, the height and width of the ink path 20 are determined at 2 to 3 mm and 3 to 5 mm, respectively.

The path forming plate 17 has, as shown in FIG. 4, a large liquid opening 21 formed at a position corresponding to the mouth 13, and a plurality of small liquid openings 22 formed at positions corresponding to the lattice-like ink paths 20. The material and manufacturing method of the plate 17 are not limited, and it is preferable to manufacture the plate 17 through plastic-molding. In FIG. 4, a number of recesses 23 are formed, corresponding to the projections 19, on the upper surfaces of the plate 13. However, as the remaining ink is stagnant in the recesses 23 after the sucking of ink, it is desirable to close the recesses 23 with film, sheet or the like, a plurality of holes 23*a* may be formed on the side walls of the recesses 23 to communicate the recesses 23 with the ink paths 20. An ink path forming plate with a flat base without recesses may be formed through injection molding.

The operation of the container 10 will now be explained.

As shown in FIGS. 1 and 2, when the inner bag 12 is filled with ink, the upper sheet portion 12*b* is expanded as indicated by a solid line to accommodate ink sufficiently. When the ink in the inner bag 12 is taken out therefrom, the ink mainly passes through the large liquid opening 21 of the flat base portion 17*a* to enter the mouth 13. In addition to the large liquid opening 21, the ink passes through the ink path 18 at the periphery of the plate 17 and the small liquid openings 22 to enter the ink paths 20 then to reach the opening of the mouth 13. Therefore, the ink is taken out through a large region in the inner bag 12. When the ink is sucked, the upper sheet portion 12*b* is deformed downwardly with its upper surface being kept almost horizontally as indicated by a dotted line 13. The ink can be thus almost completely sucked out from the inner bag 12.

In addition, even if the upper sheet portion 12*b* of the inner bag 12 is deformed distortedly in such a manner that a part of the upper sheet portion 12*b* is lowered partially to close the large liquid opening 21 of the plate 17, the ink in the inner bag 12 can be sucked out through the ink paths 20 between the plate 17 and the lower flat portion 12*c* of the inner bag 12 because the opening 13*b* of the mouth 13 is not closed by the lowered part of the upper sheet portion 12*b*. Accordingly, until most of the upper sheet portion 12*b* tightly contacts the upper surface of the plate 17, the ink can be sucked out thereby to enable almost all of ink to be taken out of the inner bag 12.

In this embodiment, the ink is sucked out through a side region in the inner bag 12, and the inner bag 12 is accommodated so that its lower sheet portion 12*a* is fixed to the inner wall of the outer box 11 and that its upper sheet portion 12*b* can be only deformed. Therefore, the upper sheet portion 12*b* can be deformed stably to enable the ink of every bag-in-box manufactured to be taken out with a small amount of the remaining ink.

Figure 5:
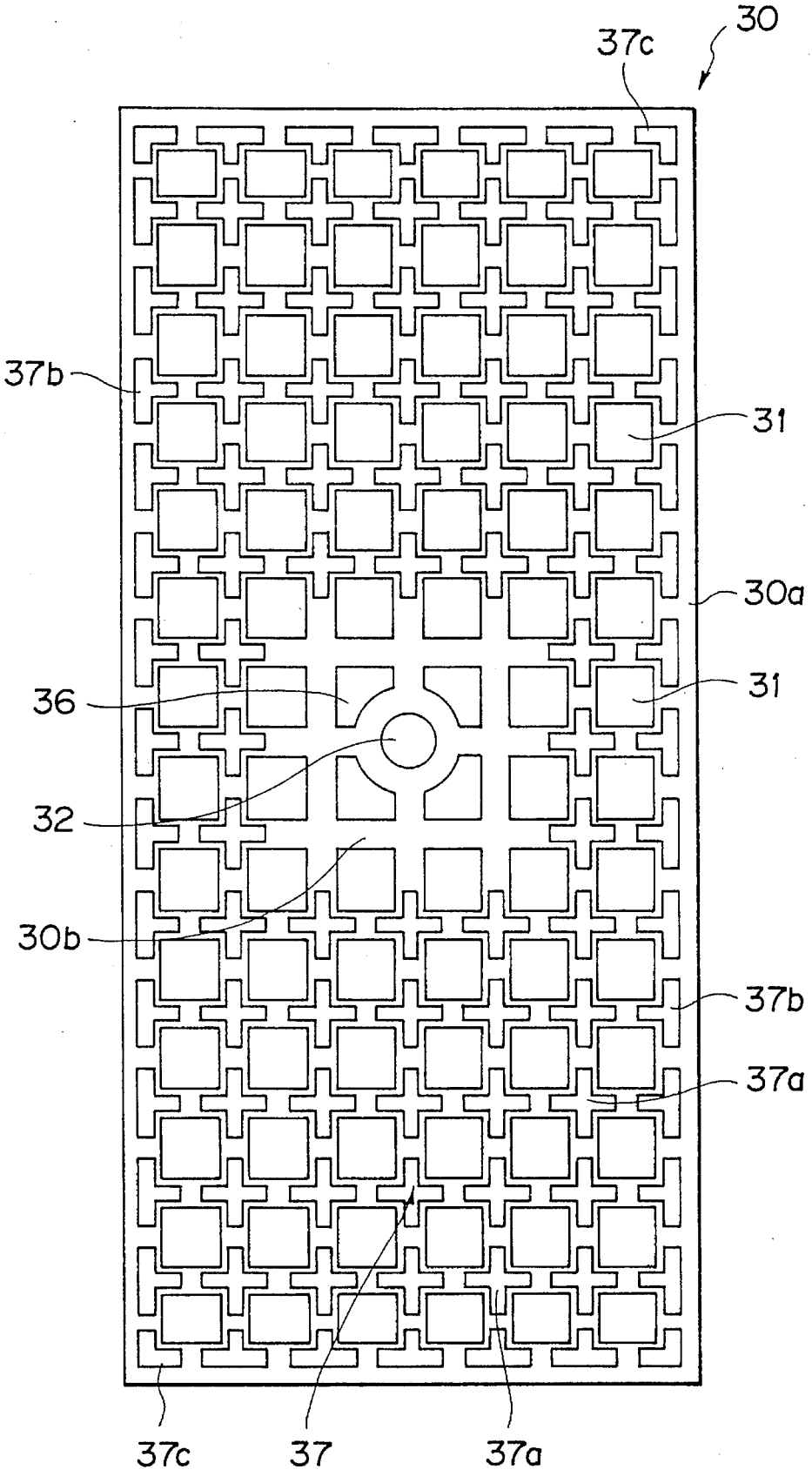
FIG. 5 is a plan view of a path forming plate showing another embodiment thereof.
Figure 6:
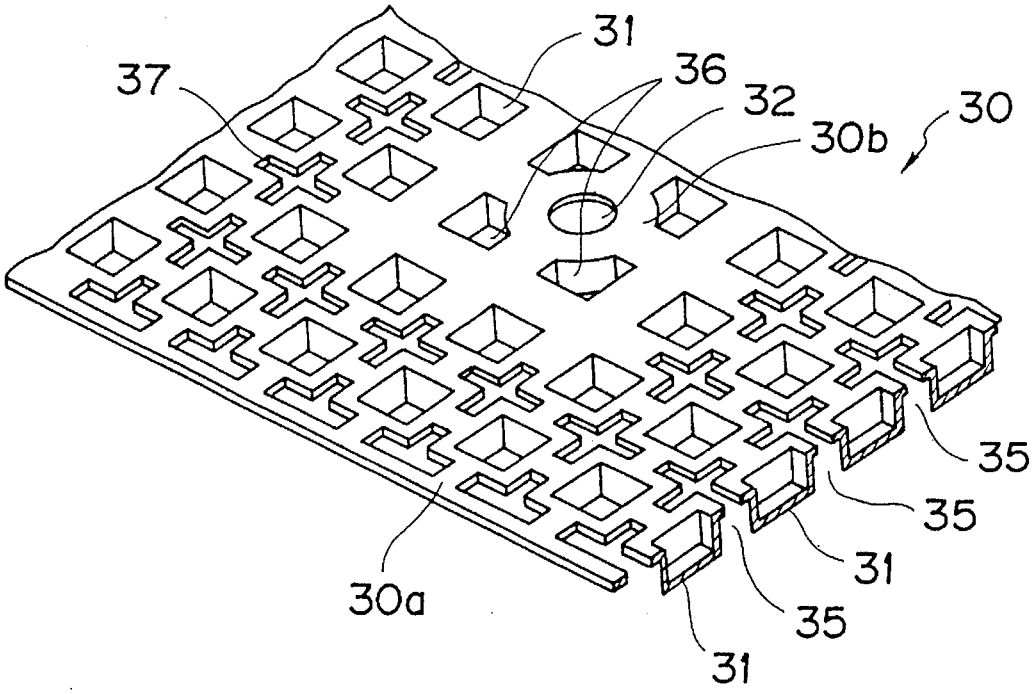
FIG. 6 is a perspective view of the path forming plate shown in FIG. 5.
Figure 7:
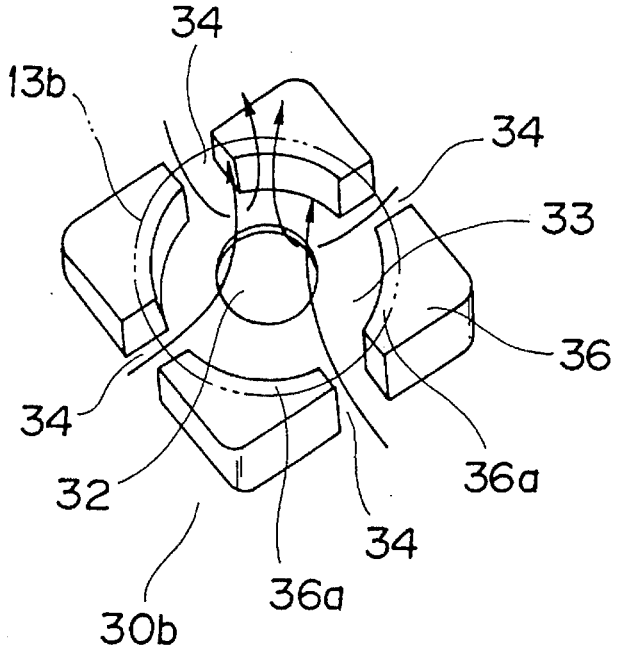
FIG. 7 is a perspective view of a center portion of the path forming plate shown in FIG. 6.
Figure 8:
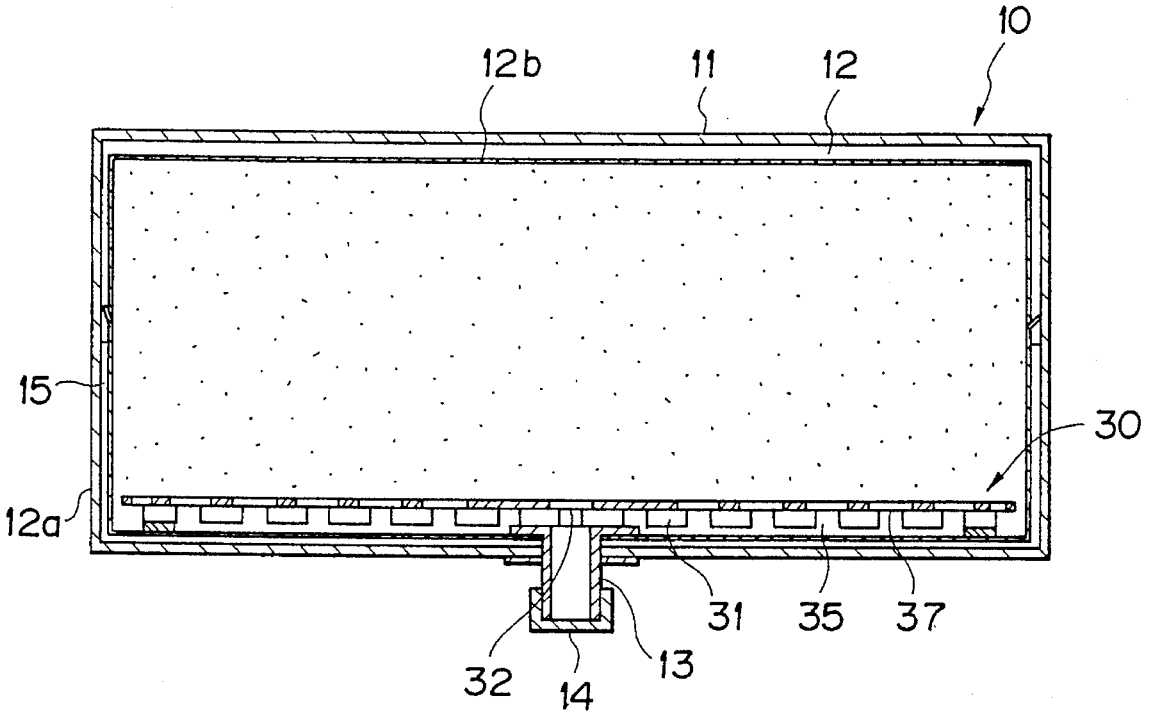
FIG. 8 is a longitudinally sectional view of a bag-in-box showing another embodiment thereof.

FIGS. 5 and 6 show another embodiment of a path forming plate 30. The plate 30 has, as a whole, a rectangular shape, and a flat base portion 30*a* and a number of square projections 31 disposed at predetermined intervals on the flat base portions 30*a*. At the center of the base portion 30*a* is provided a large liquid opening 32 for permitting the ink in the inner bag 12 to pass therethrough, and around the large liquid opening 32 is provided a circular recessed path 33 from which a liquid path 34 is extended in the four directions. Further, the plate 30 has lattice-like liquid paths 35 on the almost whole surfaces of the plate 30 except the center portion 30*b* of the base portion 30*a*. The circular recessed path 33 is defined by four deformed projections 36 separated from each other, each of which has an arched wall 36*a* surrounding the large opening 32. Further, a number of liquid openings 37 are formed at a plurality of crossing points of the lattice-like liquid paths 35 on the almost whole surface of the flat base portion 30*a* except the center portion 30*b* thereof. The liquid openings 37 comprise a number of cross-shaped openings 37*a*, a number of three-branch-shaped openings 37*b* provided along the periphery of the plate 30, and four L-shaped openings 37*c* provided at the four corners of the plate 30. The formation of the liquid openings 37 ensures that the ink in the inner bag 12 can be sucked evenly from the whole area of the path forming plate 30. The projections 31, 36 may be closed in the same manner as those of the plate 17 to prevent the ink from being stagnant therein. The plate 30, shown in FIG. 5, has the large opening 32 at the center thereof, and the mouth 13 is, as shown in FIG. 8, projected outward from the center positions of the inner bag 12 and the outer box 11. If the large opening 32 is formed at the center of the plate 30, the ink can be taken out uniformedly or evenly from the whole region in the inner bag 12. Further, the plate 30 occupies most of the lower flat surface of the inner bag 12 and, therefore, most of ink in the inner bag 12 can be taken out.

In the above embodiment, the bag-in-box 10 is disposed upside down so as to direct the mouth 13 downwardly, and however, the bag-in-box 10 is not necessarily disposed upside down. That is, the bag-in-box 10 may be disposed laterally and uprightly. Even in these cases, the ink in the inner bag 12 can be sucked out because of a sucking force of the pump. The plates 17, 30 have a number of openings 22, 37 at positions corresponding to the ink paths 20, 35, respectively. However, those openings 22, 37 are not necessarily provided, and the ink may be sucked from the peripheral space of the plates 17, 30 into the respective ink paths 20, 35. In contrast, the plates 17, 30 may have a size to completely cover the lower flat portion 12*c* of the inner bag 12 so as not to flow the ink from the peripheral space into their respective ink paths 20, 35 in a state wherein only the openings 22, 37 permit the ink to pass therethrough.

The flow of ink can be controlled by determination of the positions and number of the openings 22, 37 to form a desirable flow pattern of ink. In addition, the lower sheet portion 12*a* of the inner bag 12 is not necessarily adhered to the inner wall of the outer box 11, and the inner bag 12. may be simply accommodated in the outer box 11. The shape of the outer box 11 can be arbitrarily selected. For example, a cylindrical shape may be selected.

The type of the inner bag 12 is not limited to a pouch with four sides sealed as shown in FIGS. 1, 2 and 8, and a stand pack of a gusset type bag may be used.

The above embodiments can be adapted for a liquid container for containing other liquids in addition to ink.

The mouth of the bag-in-box may be formed in the following manner. The following mouth is suitable for taking out therethrough a liquid with a relatively high viscosity such as ink, adhesive, enrichment juice, enrichment syrup and the like.

Figure 9:
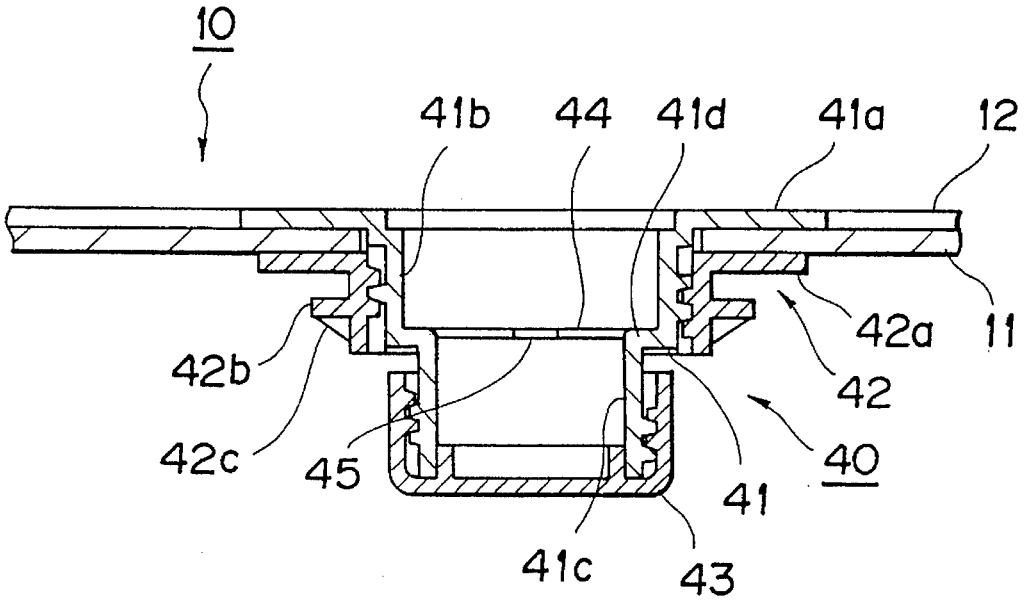
FIG. 9 is a longitudinally sectional view of a mouth fixed to the bag-in-box.
Figure 10:
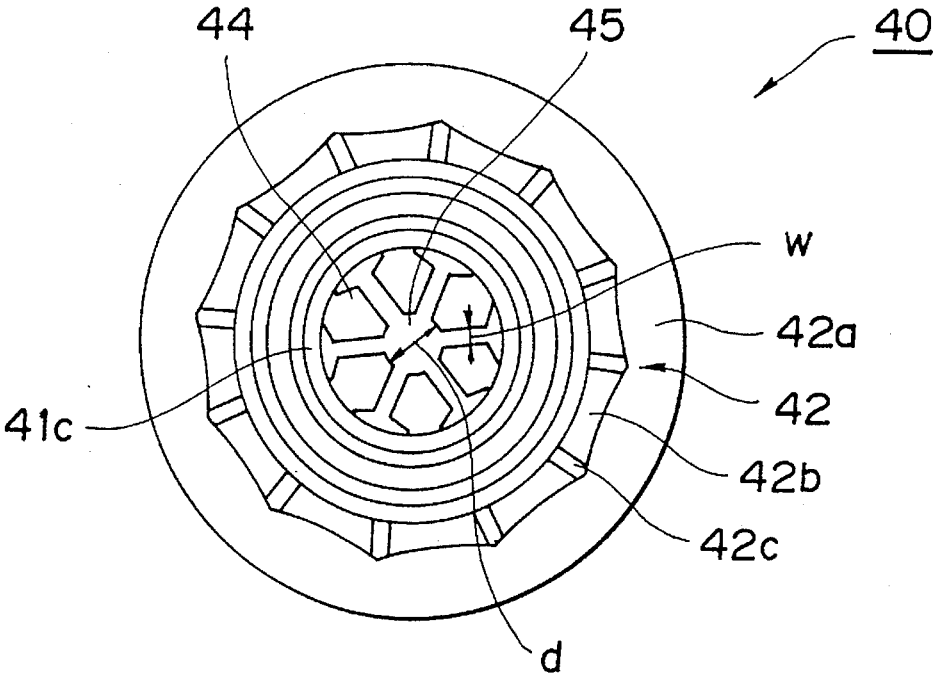
FIG. 10 is a plan view of the mouth shown in FIG. 9.
Figure 11:
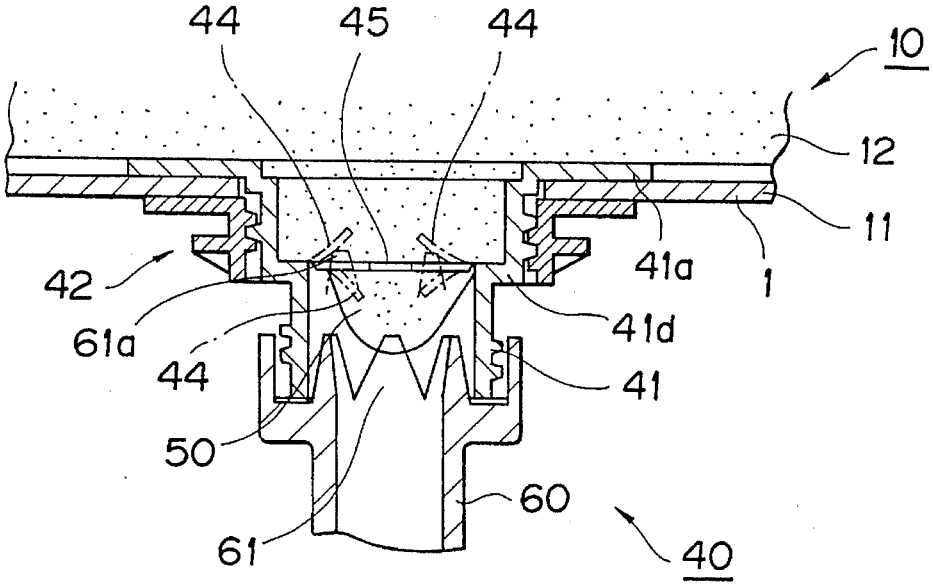
FIG. 11 is a longitudinally sectional view of the mouth showing a state wherein a connector is connected to the mouth.

In FIGS. 9 and 10, a mouth 40 comprises a main body 41 formed in a step manner, an engaging ring 42 screw-engaged with a root portion of the main body 41, and a cap 43 screw-engaged with the distal end of the main body 41. The main body 41 comprises a flange 41*a* adhered to the inner bag 12, a large diameter portion 41*b* having a male screw for engaging with the engaging ring 32 at its outer circumferential surface, a small diameter portion 41*c* having a male screw for engaging with the cap 43 at its circumferential surface and a plurality of tongue pieces 44 extended inwardly from the step portion 41*d* formed between the large and small diameter portions 41*b*, 41*c* so as to form a restricted path 45. Each tongue piece 44 is thinly formed to be elastically deformed in the axial direction of the mouth 40, and it has, e.g., a thickness of 0.4 mm. The tongue pieces 44 are disposed at an interval in the circumferential direction of the inside wall of the mouth 40 and have a snake head shape extended flatly in the direction perpendicularly to the axis of the month 42. The area of the path 45 is so determined that a liquid having a high viscosity does not instantly from out of the path 45 when the mouth 40 is directed downwardly. That is, as shown in FIG. 11, when the mouth 40 is directed downwardly, the liquid contents in the inner bag 12 flow down while forming a liquid drip 50 to come out of the mouth 40. The area of the path 45 is so determined that it takes 2 or 3 seconds until the drop 50 comes out of the mouth 40. For example, in the case of ink having a viscosity of 50 to 400 poises, it is preferable that the dimaenter d of a center path defined by the distal ends of the tongue pieces 44 is 1 to 4 mm, and the width of a plurality of spaces extended radially from the center path is 0.1 to 2 mm. The main body 41 of the mouth 40 is integrally manufactured by injection molding of resin such as polyethylene.

The bag 12 is adhered to the flange 41*a* of the main body 41 by heat sealing or the like. However, the flange 41*a* may be inserted so that the inner surface of the inner bag 12 is adhered to the front surface of the flange 41*a*.

The engaging ring 42 has a flange 42*a* abutting against the outer surface of the outer box 11, an operating portion 42*b* formed separately from the flange 42*a* and held by fingers when the ring 42 is fastened or released, and a reinforcing rib 42*c* for reinforcing the operating portion 42*b*. The main body 41 of the mouth 40 is reliably fixed to the outer box 11 in such a manner that the ring 42 is screw-engaged with the male screw of the main body 41 to put the outer box 11 between the flange 41*a* of the main body 41 and the flange 42*a* of the ring 42. The ring 42 and the cap 43 are also manufactured by injection molding of resin.

The operation of the mouth 40 will now be explained.

First, the flange 41*a*, of the main body 41 is adhered to the inner bag 11 so as to project the main body 41 outwardly from the inside of the outer box 11, and the ring 42 is screw-engaged with the male screw of the main body 41 thereby to fix the mouth 40 to the outer box 11. A liquid is poured into the inner bag 12 through the mouth 40. At this time, the liquid flows into the inner bag through the restricted path 45 provided by the tongue pieces 44 while deforming them elastically by liquid pressure to expand the restricted path 45. This enables prompt filling of the liquid. Further, a filling nozzle for filling the liquid into the inner bag 12 may be formed so that a part of the filling nozzle pushes the tongue pieces to expand the restricted path 45 when the nozzle is engaged with the mouth 40. After the liquid is filled into the inner bag 12, the mouth 40 is covered with the cap 43. With this state, the bag-in-box 10 is transported and stored.

When the liquid is taken out of the bag-in-box 10, the cap 43 is disconnected from the mouth 40, and a connector 60 connected to a pump is connected to the mouth 40. Thus, the liquid is sucked out by the operation of the pump. When the mouth 40 is connected to the connector 60, the bag-in-box 10 is placed upside down to connect the mouth 40 with the connector 60 from the above. At this time, if the mouth 40 is directed downwardly in a state wherein the cap 43 is disconnected therefrom, the liquid in the inner bag 12 is going to flow out through the restricted path 45. However, as the area of the path 45 is small, the liquid flows downwardly while forming the liquid drop 50. Therefore, the liquid does not flow out of the mouth 40 for a relatively short time until the mouth 40 is connected with the connector 60. After the connector 60 is connected to the mouth 40, the liquid is sucked out by the pump. At this time, each tongue piece 44 is curved downwardly by the suction force to expand the restricted path 45.

The connector 60 may be formed so as to have a long projection 61*a* so that the long projections 61*a* pushes upwardly the tongue pieces 44 to expand the restricted path 45 when the connector 60 is engaged with the mouth 40.

In the above embodiment, the restricted path 45 is formed of a plurality of elastically deformed tongue pieces 44, and, however, a circular path, an elliptic path, groove-like path and the like may be simply formed. If the path 45 is formed of the elastic tongue pieces, the pass resistance of the liquid is decreased because of the expansion of the path 45 by the elastic deformation of the tongue pieces. The engaging ring 42 is not necessarily provided, and the mouth 45 may be simply projected from the outer box 11. The above mouth can be adapted for other boxes in addition to the bag-in-box 10.

Next, another embodiment will now be explained with reference to FIGS. 12 to 15.

Figure 13:
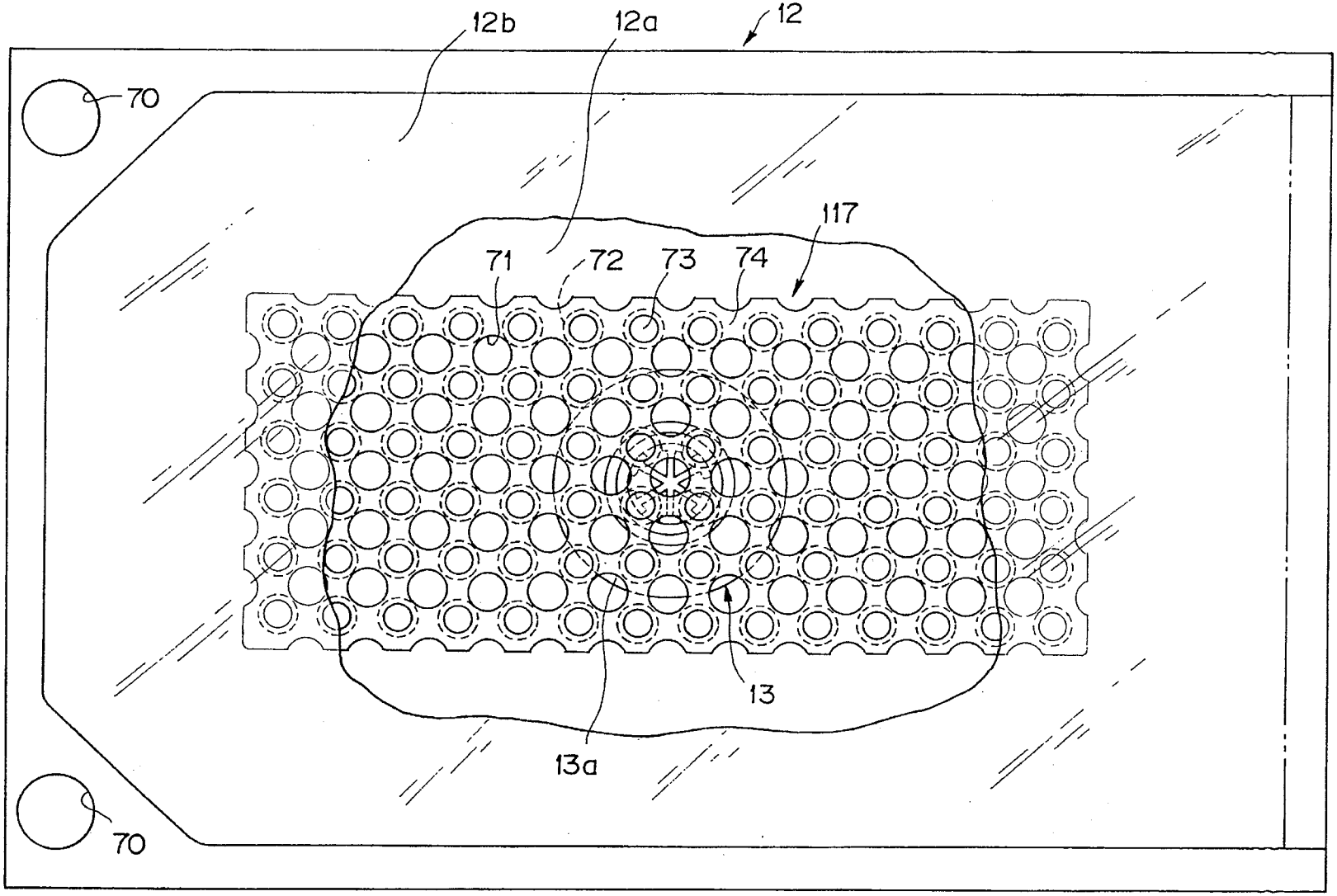
FIG. 13 is a plan view, partially broken, of an inner flexible bag shown in FIG. 12.
Figure 14:
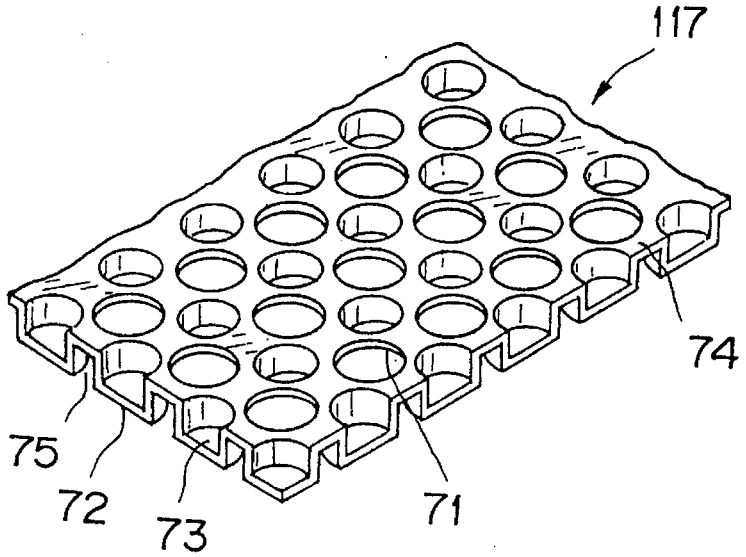
FIG. 14 is a perspective view of a path forming plate shown in FIG. 12.

In this embodiment, the structure of the outer box 11 is the same as that of the above embodiment. An inner flexible bag 12 is, as shown in FIG. 13, a sealed bag which is so formed that a lower sheet portion 12*a* and an upper sheet portion 12*b* are joined at their peripheries. The upper and lower sheet portions 12*a*, 12*b* are transparent, flexible and rectangular sheets. The inner flexible bag 12 accommodates a path forming plate 117 therein with which the lower flat portion 12 (center region) of the lower sheet portion 12*a* of the inner bag 12 is covered and which is made of plastic. The mouth 40 is fixed integrally to the center portion of the lower sheet portion 12*a*. Two corner portions on one side of the inner bag 12 form two triangularly joined portions each having a circular hole 70 as shown in FIG. 13.

Figure 12:
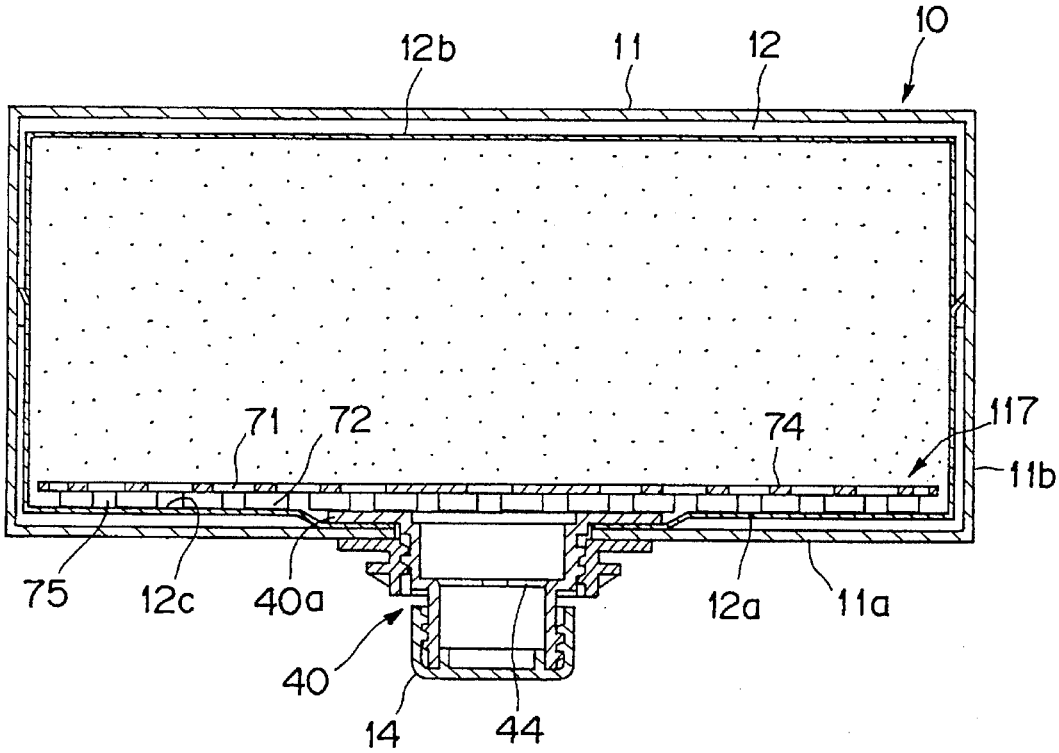
FIG. 12 is a longitudinally sectional view of a bag-in-box showing still another embodiment thereof.

The circular hole 70 is used for an operation in which a machine holds the inner flexible bag 12 when liquid content is filled into the inner flexible bag 12. The opposite side to the triangular joined portions is opened before filling of liquid content and is sealed after filling of liquid content. When the liquid content is filled into the inner flexible bag, the bag is expanded and accommodated in the outer bag 11 as shown in FIG. 12. At this time, the path forming plate 117 defines the lower flat portion 12*c* of the lower sheet portion 12*a* because of its rigidity. The path forming plate 117 is rectangular thin plate material which has a number of circular liquid openings 71 and a number of projections 72 disposed adjacent to the liquid openings 71. Each projection 72 has a cylindrical shape with a projected and which contacts the lower sheet portion 12*a* of the inner flexible bag 12. That is, each projection 72 forms a recess 73. The projections 72 are disposed in a lattice-like manner at predetermined intervals and the liquid openings 71 are also disposed in a latticee-like manner between the projections 72. Each projection 72 has a flat projected end face which is joined by adhesive to the inner surface of the lower sheet portion 12*a* lot the inner flexible bag 12. Some projections 72 are joined to the flange 40*a* of the mouth 40. in that manner, lattice-like paths 75 are formed by the projections 72. Since the lower sheet portion 12*a* of the inner flexible bag 12 is supportd by a number of projections 72, a part of the lower sheet portion 12*a* does not come into the lattice-like paths to maintain a liquid path having a constant sectional area. Further, since each projection is cylindrical and has no sharp corner. Therefore, even a liquid with a high viscosity can smoothly flow in the lattice-like paths.

Figure 15:
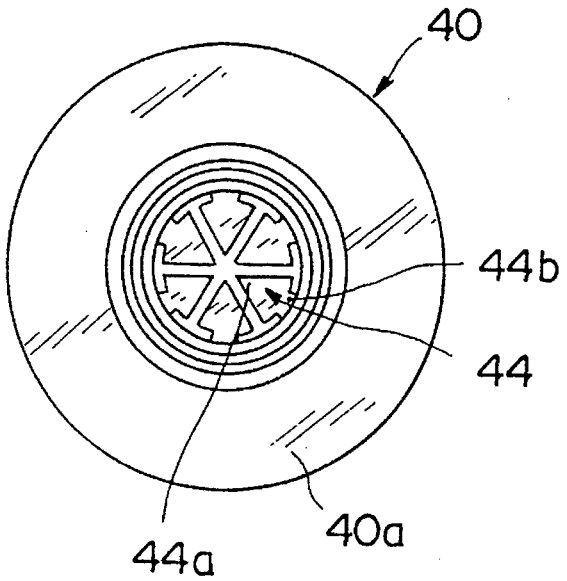
FIG. 15 is a plan view of the mouth of the inner flexible bag shown in FIG. 12.

The mouth 40 has six tongue pieces 44, 44—44 therein as shown in FIG. 15. Each tongue piece 44 has a snake-like head 44*a* and a neck portion 44*b* with a narrow width for ensuring elastic movement of the snake-like head 44*a*.

Furthermore, other embodiments will now be explained with reference to FIGS. 16 to 26.

Figure 20:
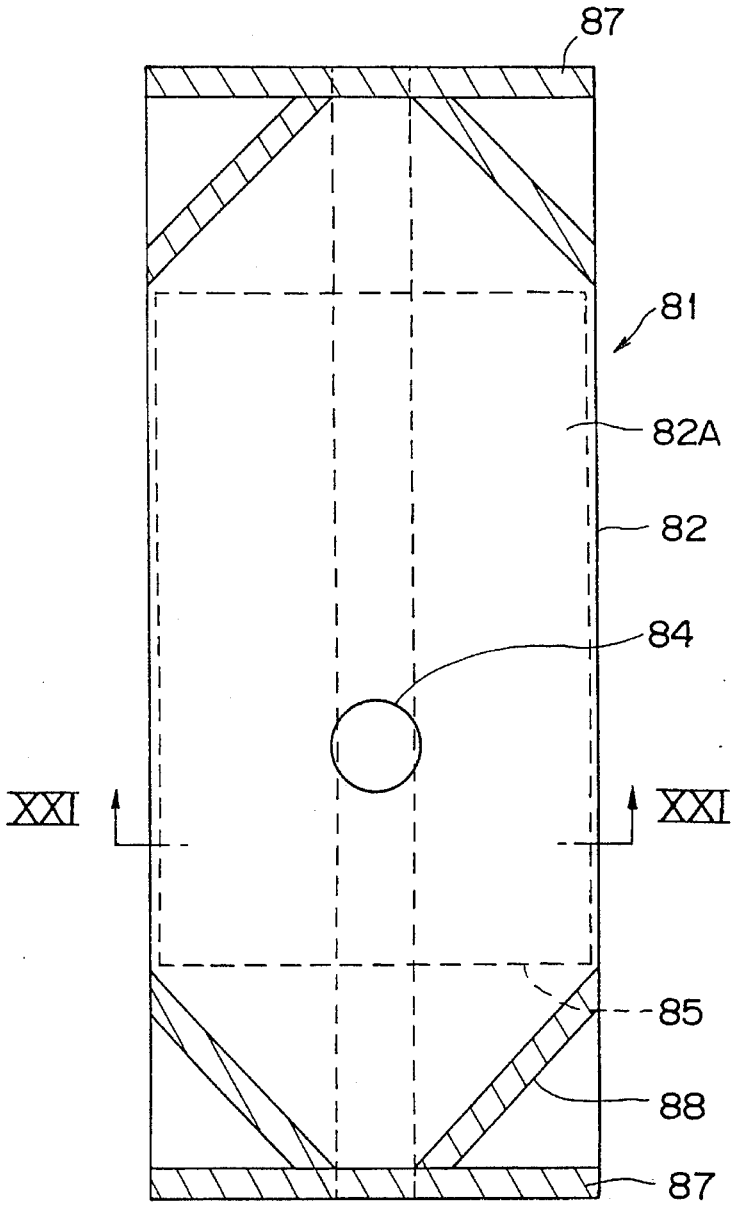
FIG. 20 is a plan view of the liquid container showing a state where liquid contents have not been filled yet.
Figure 21:
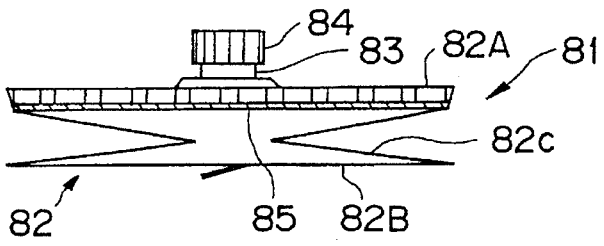
FIG. 21 is a sectional view taken along the line XXI—XXI.

A liquid container 81 comprises a flexible bag 82, a mouth 83 fixed to the gusset bag 82, a cap 84 screw-engaged with the mouth 83, a path forming plate 85 and a flat plate 86 attached to the outer surface of the upper flat portion 82*b* of the gusset bag 82. The gusset bag 82 is, as shown in FIGS. 20 and 21, so formed that a cylindrical sheet is folded at two side folding portions 82*c*, 82*c* between two lower and upper flat portions 82*a*, 82*b* on the opposite sides thereof and the opposite ends of the gusset bag 82 in the longitudinal direction are sealed to form two end sealing portions 87, 87. Further, the lower and upper flat portions 82A, 82B and two end folding portions of the bag 82 in the longitudinal direction thereof are sealed obliquely to each other to form four sealing portions 88, 88—88. When liquid content is filled into the bag 82 to expand it, the bag 82 becomes approximately a cube. The bag 82 is made of normal soft packaging material, for example, laminate material of resin film. The gusset bag 82 is sometimes used without an outer box. Therefore, it must have a necessary strength. The laminated structure of the gusset bag 82 is selected in consideration of a necessary strength, a barrier property and a heat-sealing property. For example, a laminated sheet of nylon 15 μ/polyethylene 60 μ, and a laminate sheet of polypropylene 60 μ/nylon 15 μ/polyethylene 60 μ are used. If necessary, a metal foil is disposed in a laminate sheet. The gusset bag 82 itself of a soft packaging sheet material is apt to be round as a whole when it is expanded or is apt to be deformed in case that liquid content is heavy. However, in this embodiment, the path forming plate 85 and the flat plate 86 reinforces the bag 82 to prevent deformation of the bag 82.

Figure 16:
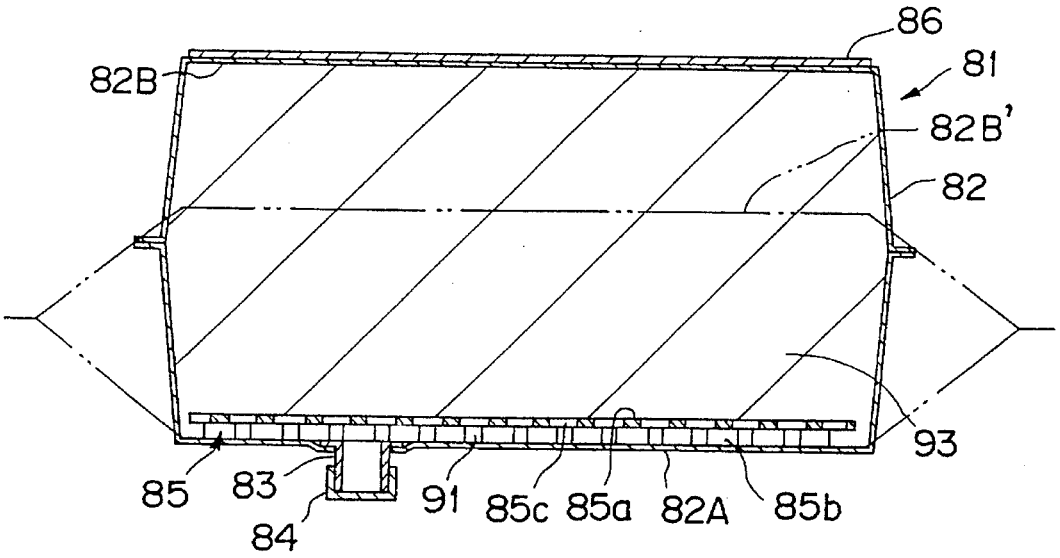
FIG. 16 is a longitudinally sectional view of a liquid container showing still another embodiment thereof.
Figure 17:
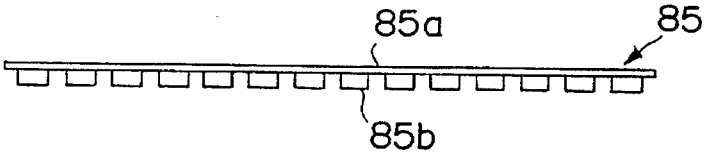
FIG. 17 is a schematic side view of a path forming plate accommodated in the liquid container shown in FIG. 16.
Figure 18:
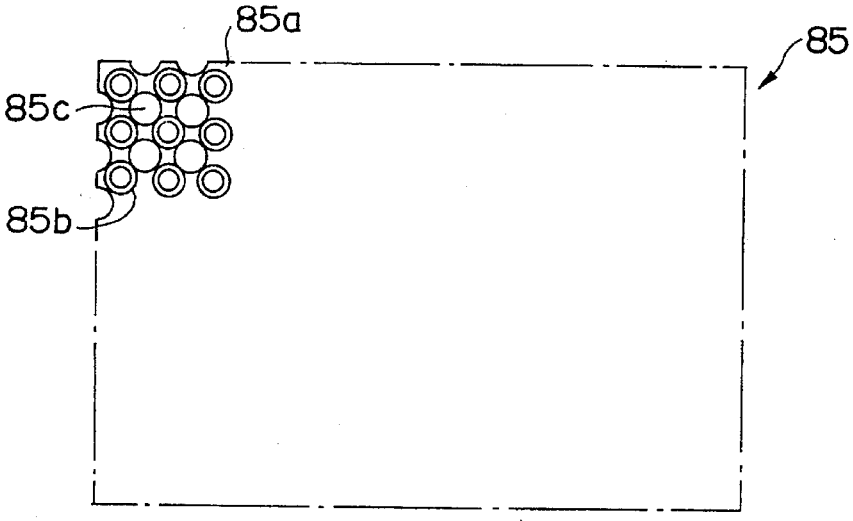
FIG. 18 is a schematic plan view of the path forming plate shown in FIG. 17.
Figure 19:
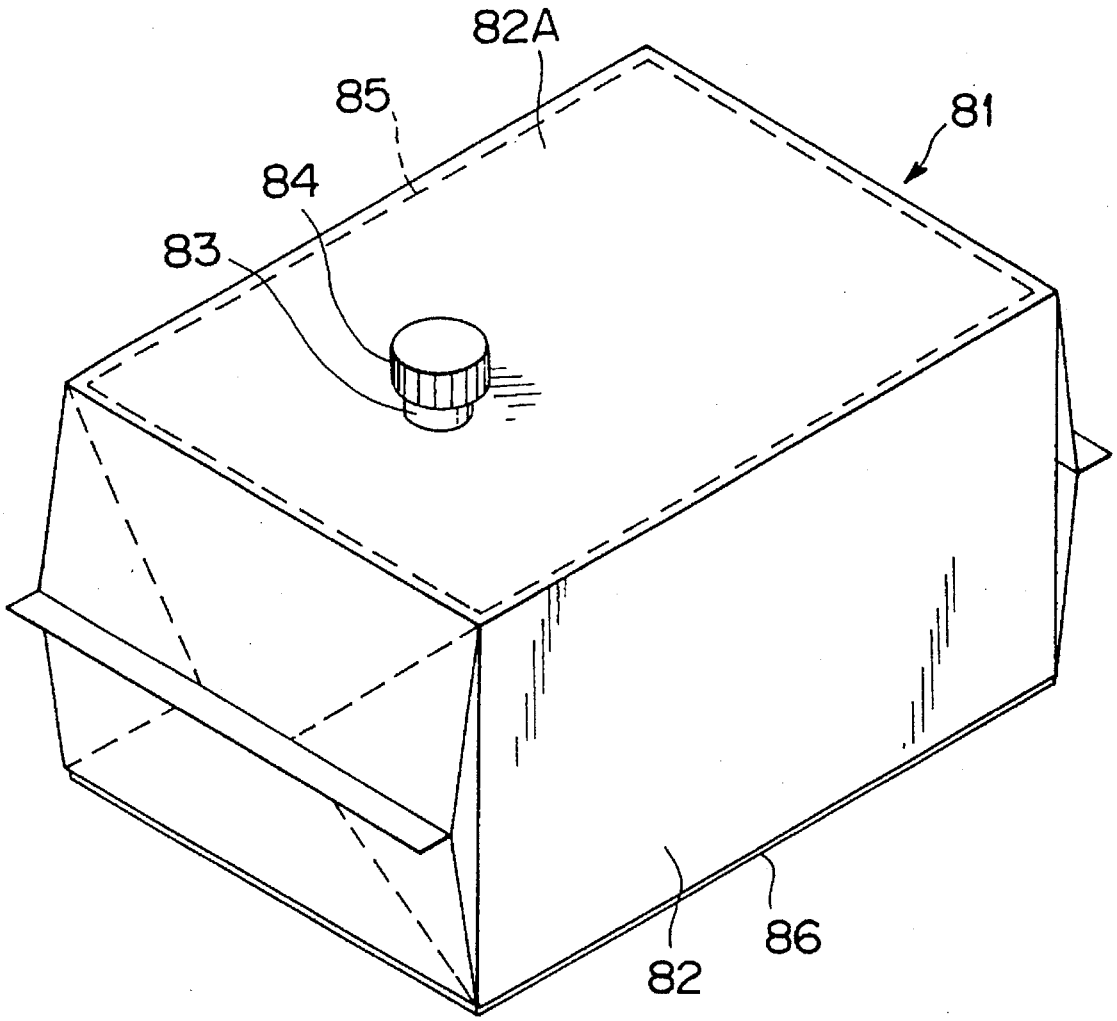
FIG. 19 is a schematic perspective view of the liquid container shown in FIG. 16.
Figure 22:
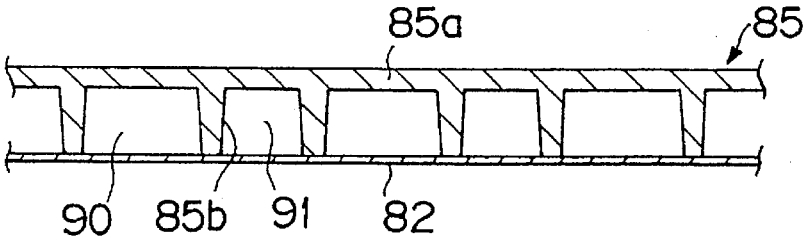
FIG. 22 is a schematic sectional view in which a joint portion between the path forming plate and a gusset bag is cut along the center line of cylindrical projections of the path forming plate.
Figure 23:
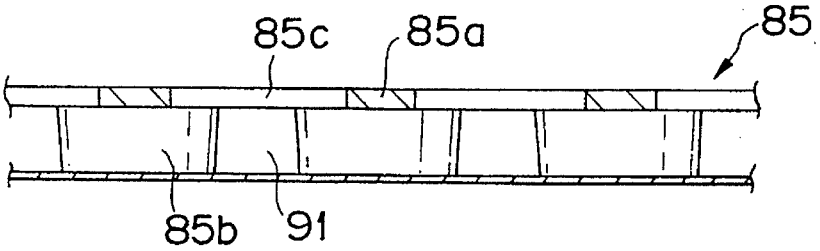
FIG. 23 is a schematic sectional view in which a joint portion between the path forming plate and the gusset bag is cut along the center line of liquid openings of the path forming plate.
Figure 24:
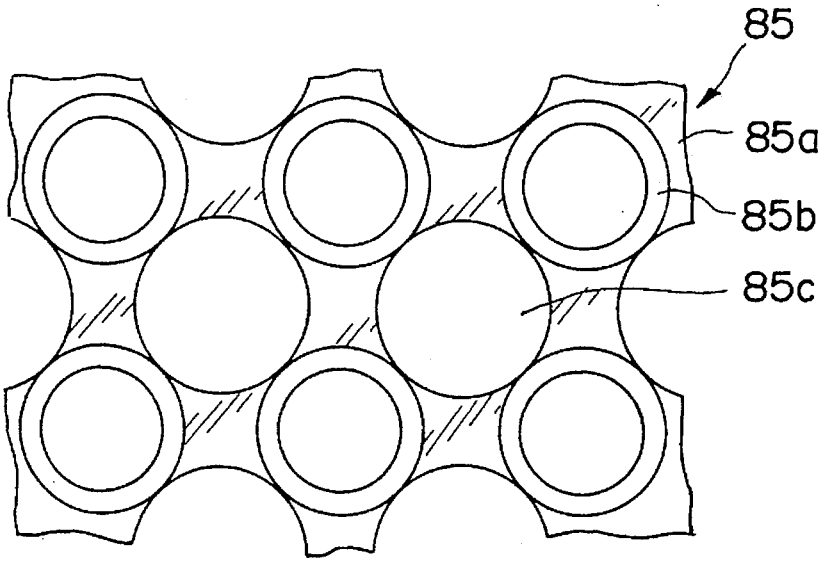
FIG. 24 is an enlarged bottom view of the path forming plate shown in FIG. 16.

The mouth 83 is fixed to the inner surface of the gusset bag 82. The path forming plate 85 is also fixed to the lower flat portion 82A so as to cover the almost all of the lower flat portion 82A therewith (FIGS. 16 and 19). That is, the path forming plate 85 has an area approximately equal to the rectangular lower flat portion 82A. The path forming plate 85 comprises a flat base portion 85*a*, a plurality of cylindrical projections 85*b*, 85*b*—85*b* projected from one side of the flat base portion 85*a* and having a predetermined height, a plurality of liquid openings 85*c*, 85*c*—85*c* disposed between the projections 85*b*. Each projection 85*b* has a hollow shape and is closed, at its root portion, with the base portion 85*a* while the projected end face is opened. The projections 85*b* and the liquid openings 85*c* are disposed at a predetermined pitch approximately on the whole area of the flat base portion 85*a*, the path forming plate 85 is made of resin end has a rigidity bigger than the sheet material of the gusset bag 82. The projected end of each projection 85*b* is adhered to the inner surface of the rectangular lower flat portion 82A through a heat-seal operation. Therefore, the hollow space 90 of each projection 85*b* is closed by the portion 82A to prevent liquid content in the gusset bag 82 from coming into the projection 85*b*. Liquid paths 91 formed outside of the projections 85*b* extend in a lattice manner between the lower flat portion 82A of the gusset bag 82 and the base plate portion 85*a*, and are communicated with the mouth 83, as shown in FIG. 22, and the upper space of flat base portion 85*a* through the liquid openings 85*c*. In general, the size of each projection 85*b* is determined at a height of 1–5 mm, a diameter of 5–10 mm and an interval, between two projections, of 3–6 mm. The projection may have a hollow rectangular shape.

In FIG. 16, the flat plate 86 is fixed to the upper flat portion 82B opposed to the lower flat portion 82A and has an area approximately equal to that of the upper flat portion 82B. The flat plate 82 has a rigidity bigger than that of sheet material of the gusset bag 82 and can always maintain the portion 82B flat. The flat plate 86 may be made of a resin plate or a thick paper plate, and may be provided on the inner plate of the rectangular upper flat portion 82B.

In this embodiment, the path forming plate 85 and the flat plate 86 are fixed to the lower rectangular flat portion 82A and the upper rectangular flat portion 82B, respectively.

Therefore, the lower and upper flat portions 82A, 82B are maintained flat to maintain the cube shape of the gusset bag 82 even when ink or the like is filled into the gusset bag 82. When the liquid content is sucked out, the upper flat portion 82B is lowered in a flat manner as indicated by an imaginary line 82B' in FIG. 16. Therefore, the liquid content of the bag 82 can be sucked out until the upper flat portion 82B contacts the whole portion of the path forming plate 85.

Figure 25:
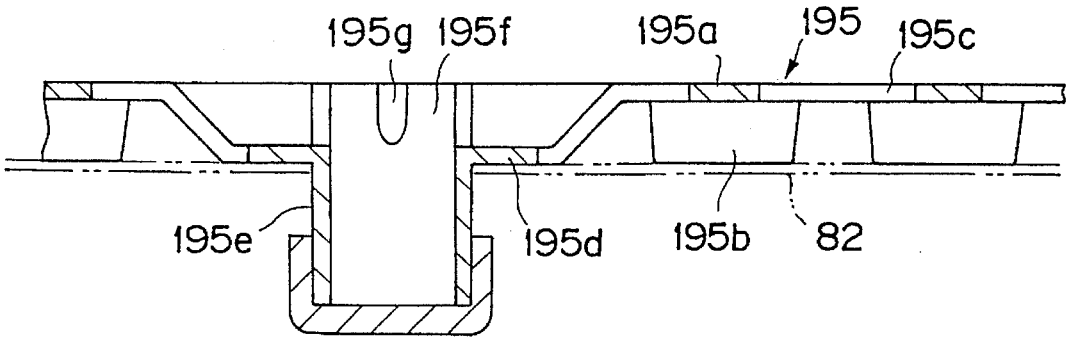
FIG. 25 is an enlarged schematic sectional view of the path forming plate which is integrally provided with a mouth.
Figure 26:
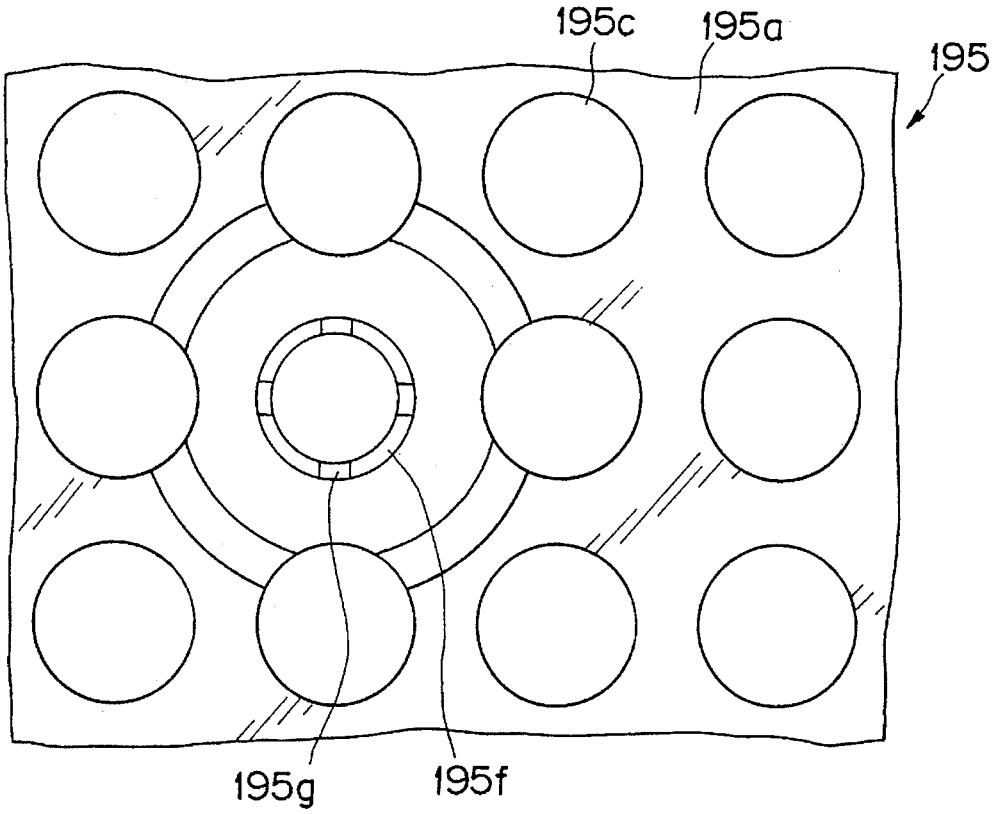
FIG. 26 is a plan view of the path forming plate shown in FIG. 25.
Figure 27:
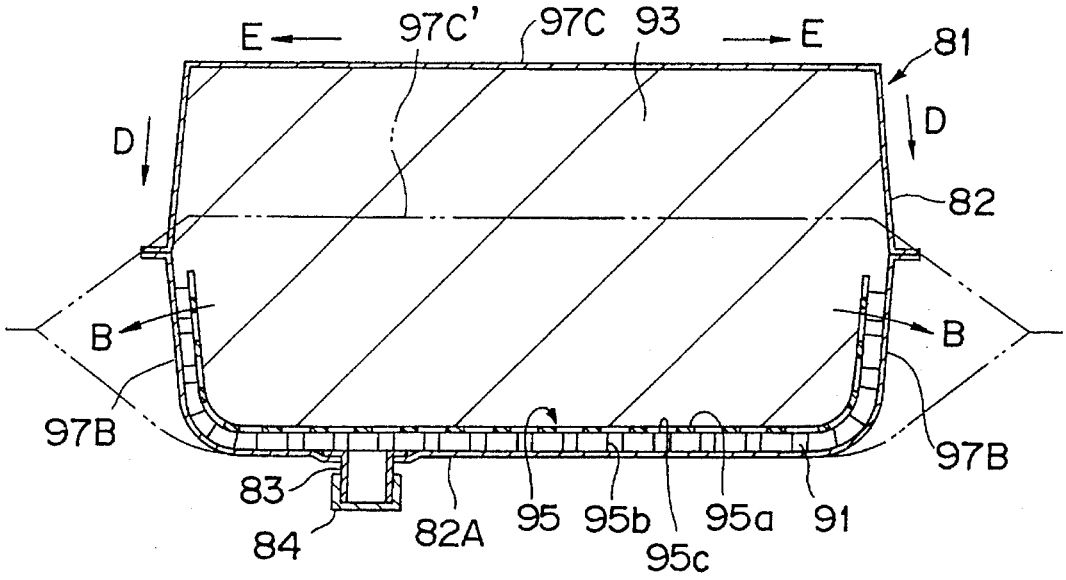
FIG. 27 is a schematic sectional view of a liquid container showing still another embodiment.
Figure 28:
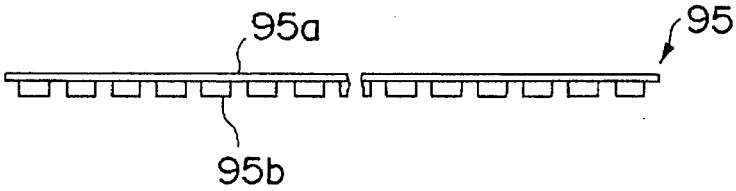
FIG. 28 is a schematic side view of a path forming plate accommodated in the liquid container shown in FIG. 27.

In the above embodiment, the mouth 83 and the path forming plate 85 are formed independently of each other. However, they may be formed integrally as shown in FIGS. 25 and 26. A path forming plate 195 comprises a flat base portion 195*a*, a plurality of cylindrical projections 195*b*, 195*b*—195*b* and a plurality of liquid openings 195*c*, 195*c*, 195*c*. The flat base portion 195*a* has a recess portion 195*d* which is approximately equal to each projection 195*b* in height so as to form a mouth 195*e* at its center portion. On the opposite side of the mouth 195 is provided a cylindrical wall 195*f* having a plurality of longitudinal grooves 195*g*, 195*g*—195*g* as openings for communicating the mouth with the liquid path 91, and extending in flush with the flat base portion 195*e*. The recess portion 195*d* and the distal end of each projection 195*b* are heat-sealed to the inner surface of the gusset bag 82. The cylindrical wall 195*f* functions to prevent an inner deformed surface of the bag 82 in accordance with the decrease of the content from closing the inlet of the mouth 195*e*.

FIGS. 27 to 30 show still another embodiment of the present invention.

Figure 29:
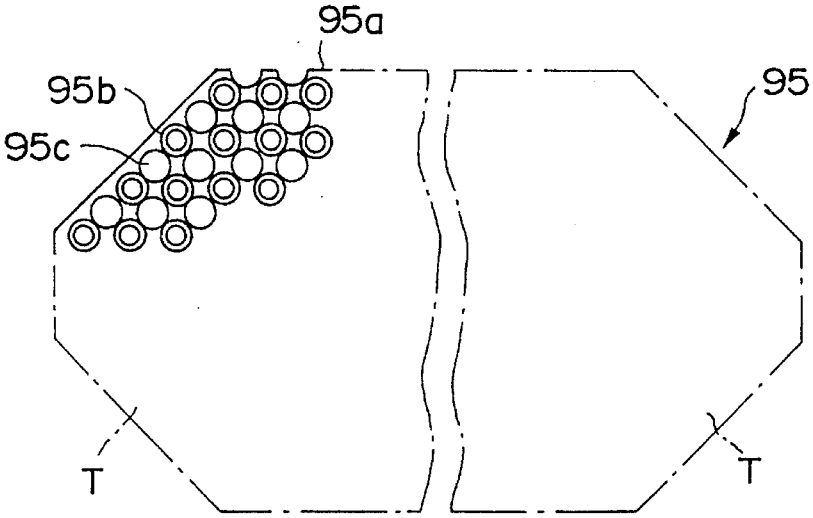
FIG. 29 is a schematic plan view of the path forming plate shown in FIG. 28.
Figure 30:
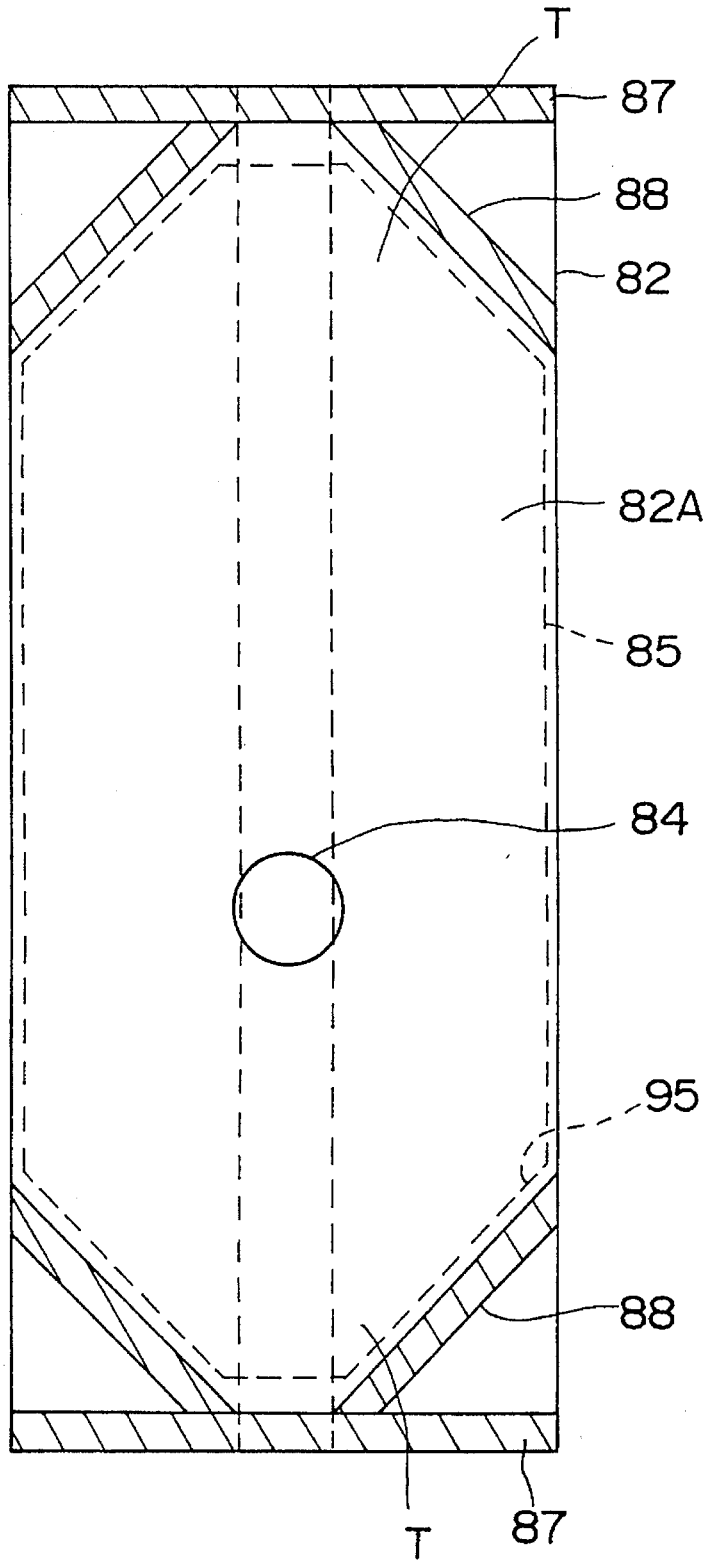
FIG. 30 is a schematic plan view in which liquid contents have not be filled yet in the above liquid container.

In this embodiment, a path forming plate 95 is different from that of the above embodiments. That is, the path forming plate 95 only reinforces the gusset bag 82 without a flat plate on the upper surface of the gusset bag 82. The path forming plate 95 has, as shown in FIGS. 29 and 30, a pair of trapezium portions T, T which are disposed in oblique sealed portions 88, 88 of the gusset bag 82. The sealed portions 88, 88 form two vertical side walls 97B, 97B in the opposite sides in the longitudinal direction of the gusset bag 82. The path forming plate 95 has an elasticity so as to be curved eelastically at its opposite ends when the gusset bag 82 are expanded to be a cube by filling content such as ink therein. In this case, the elastic trapezium portions T, T impart a force to expand the liquid container 81 in its longitudinal direction (as indicated by arrows B, B) thereby to impart tensions E, E in the longitudinal directions of the container 81 on an upper flat portion 97*c* and tensions D, D as indicated by arrows D, D on the opposite upper side walls. Therefore, the upper flat portion 97*c* is maintained flat or as a curbed surface with a large radius. Further, when liquid content 93 is sucked out, the upper flat portion 97*c* is, as shown by an imaginary line 97*c*', lowered in a state parallel to the lower flat portion 82A in accordance with the decrease of the liquid content 93. A wrinkle is hardly generated on the upper flat portion 97*c* to prevent the content from being held partially in the wrinkle. The path forming plate 95 comprises a flat base portion 96*a*, a plurality of projections 95*b*, 95*b*,—95*b*, each of which has an open distal end face, and a plurality of liquid openings 95*c*, 95*c*—95*c*. The structure of these projections 95*b* and liquid openings 95*c* is the same as that shown in FIG. 16. The thickness of the trapezium portions T, T may be different from that of the main portion of the flat base portion 95*a* to obtain a proper elasticity. The projections 95*b* and liquid openings 95*c* may be eliminated from the trapezium portions T, T. The path forming plates 17, 117, 85, 195, 95 can be exchanged alternately in any embodiments.

What is claimed is:

1. A liquid container for containing a liquid therein which comprises:

a) an outer box having at least one flat wall;

b) a flexible inner bag accommodated in the outer box;

c) a mouth fixed to the inner bag so as to be projected outwardly of the flat wall of the outer box; and d) a path forming member in the shape of a flat wall provided along the flat wall of the outer box in the inner bag so as to cover almost all of the flat wall of the inner bag, including the mouth therewith for ensuring a liquid path between the flat wall of the inner bag and a flat base portion of the path forming member, all liquid paths being connected to the mouth, the path forming member having a plurality of liquid openings for communicating the liquid paths with an upper space over the path forming member in the inner bag, wherein the path forming member has a number of projections provided at predetermined intervals, and is acommodated in the inner bag with the projections directed toward the flat wall of the inner bag so as to form lattice-like liquid paths.

2. A liquid container according to claim 1, wherein the path forming member has a large liquid opening at a position corresponding to the mouth.

3. A liquid container according to claim 1, wherein the path forming member is formed by injection molding, a number of recesses being formed corresponding to the projections, at least one opening to communicate each recess with the lattice-like liquid paths.

4. A liquid container according to claim 1, wherein the path forming member is formed by injection molding, a number of recesses being formed corresponding to the projections, the recesses being covered with a film member.

5. A liquid container according to claim 1, wherein the liquid openings are provided at crossing points of the lattice-like liquid paths.

6. A liquid container according to claim 1, wherein a circular liquid path is formed around the large liquid opening by projections each having an arched surface.

7. A liquid container according to claim 1, wherein the flexible inner bag is formed of upper and lower sheet portions whose peripheries are sealed to each other, the mouth being fixed to the lower sheet portion, the path forming member being disposed in a center region of the lower sheet portion so as to form a cube when liquid content is filled into the flexible inner bag, at least part of the projections being adhered to the inner surface of the lower sheet portion.

8. A liquid container according to claim 7, wherein each of the projections of the path forming member has a hollow shape whose projected end face is closed.

9. A liquid container according to claim 7, wherein each of projections of the path forming member has a hollow shape whose projected end face is opened in a state wherein a root portion of the projection is closed with a flat base portion of the path forming member.

10. A liquid container according to claim 7, wherein the projections of the path forming member is cylindrical, the liquid openings being circular, the projections and the liquid openingsbeing disposed at a predetermined pitch in a lattice manner with each other.

11. A liquid container according to claim 7, wherein the path forming member is formed integrally with the mouth.

12. A liquid container according to claim 1, wherein the mouth comprises a main body fixed to the container for containing the liquid and having a restricted path inside thereof for flowing the liquid with a high viscosity out of the mouth, the restricted path being formed of a plurality of elastic tongue pieces projected radially from an inner wall of the mouth, the tongue pieces being extended flatly in a direction perpendicularly to an axis of the mouth, and a cap detachably provided on the mouth to close and open the mouth.

13. A liquid container for containing a liquid therein and the like which comprises:

a) a flexible bag for containing the liquid therein:

b) a mouth fixed to the flexible bag so as to be projected outwardly of the bag; and c) a path forming member in the shape of a flat wall provided in the flexible bag so as to cover almost all of a lower flat portion of the flexible bag to which the mouth is fixed when the liquid is filled into the bag for ensuring liquid paths between a flat base portion of the path forming member and the lower flat portion, all liquid paths being connected to the mouth, the path forming member having a plurality of liquid openings for communicating the liquid paths with an upper space over the path forming member, the path forming member having a number of projections provided at predetermined intervals, and is accomodated in the flexible bag with the projections directed toward the lower flat portion of the flexible bag.

14. A liquid container according to claim 13, wherein the flexible bag comprises an upper sheet portion and a lower sheet portion having the mouth, the upper and lower sheets being joined at their peripheries in a state wherein the path forming member is disposed in a center region of the lower sheet portion, corresponding to the lower flat portion when the flexible bag is expanded by filling the liquid into the bag.

15. A liquid container according to claim 13, wherein the liquid openings of the path forming member are circular, each of the projections thereof having a hollow cylindrical shape whose projected end face is closed with a root portion of each projection being opened.

16. A liquid container according to claim 13, wherein each of the projection of the path forming member has a hollow cylindrical shape whose projected end face is opened with a root portion of each projection being closed with a flat base portion, the projected end face of each projection being adhered to the lower flat portion.

17. A liquid container according to claim 13, wherein the mouth is formed integrally with the path forming member.

18. A liquid container according to claim 17, wherein the mouth is provided with a recess portion from which the mouth is projected outwardly of the flexible bag, a cylindrical wall being extended inwardly of the flexible bag on the opposite side of the mouth, the cylindrical wall having openings for communicating the mouth with the liquid paths between the flat base portion of the path forming member and the lower flat portion of the flexible bag.

19. A liquid container according to claim 13, wherein the flexible bag is a gusset bag whose upper flat portion has a rigid flat plate.

20. A liquid container according to claim 13, wherein the flexible bag is a gusset bag, both ends of the path forming member being opposed to two side portions of the flexible bag when the liquid is filled into the flexible bag and having an elasticity to expand the side portions of the flexible bag outwardly.

* * * * *